US006258499B1

(12) United States Patent
Itami

(10) Patent No.: US 6,258,499 B1
(45) Date of Patent: Jul. 10, 2001

(54) ELECTROPHOTOGRAPHIC PHOTORECEPTOR, AN IMAGE FORMING METHOD, AN IMAGE FORMING APPARATUS, AND AN APPARATUS UNIT

(75) Inventor: Akihiko Itami, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/479,633

(22) Filed: Jan. 7, 2000

(30) Foreign Application Priority Data

Jan. 13, 1999 (JP) ..... 11-006326

(51) Int. Cl.[7] ..... G03G 15/04

(52) U.S. Cl. ..... 430/66; 430/67; 430/56; 430/59.6; 430/96

(58) Field of Search ..... 430/67, 66, 56, 430/59.6, 96

(56) References Cited

U.S. PATENT DOCUMENTS 6,016,414 * 1/2000 Anayama et al. ..... 399/159
6,040,099 * 3/2000 Hanami et al. ..... 430/66
6,146,800 * 11/2000 Yoshida et al. ..... 430/67

* cited by examiner

*Primary Examiner*—Mark Chapman
(74) *Attorney, Agent, or Firm*—Jordan B. Bierman; Bierman, Muserlian and Lucas

(57) ABSTRACT

An electrophotographic photoreceptor is disclosed. The photoreceptor comprises an electrically conductive support having thereon a photosensitive layer in which the glass transition temperature of the surface layer of said photosensitive layer is at least 105° C. and the contact angle of said surface layer with respect to deionized water is at least 90°. An image forming method, an apparatus and a unit employing the photoreceptor are also disclosed.

16 Claims, 2 Drawing Sheets

FIG. 1 (1)
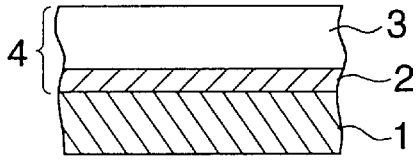
FIG. 1 (2)
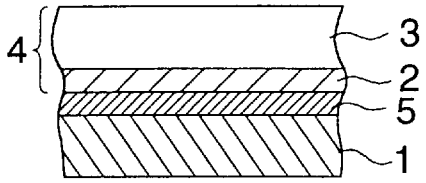
FIG. 1 (3)
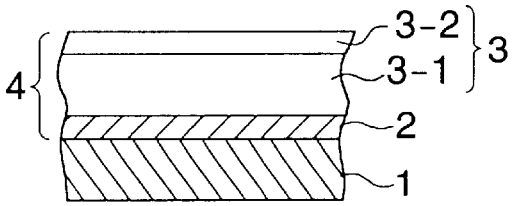
FIG. 1 (4)
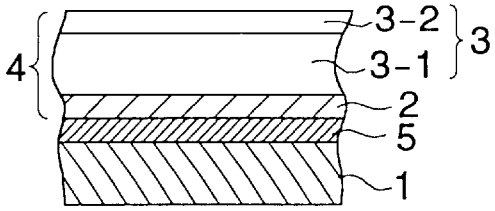
FIG. 1 (5)
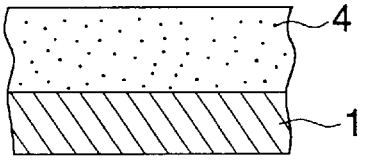
FIG. 1 (6)
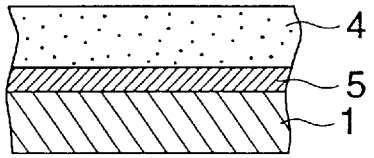
FIG. 1 (7)
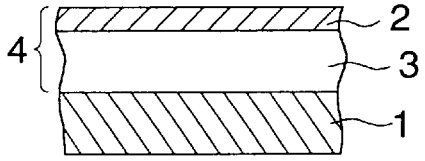
FIG. 1 (8)
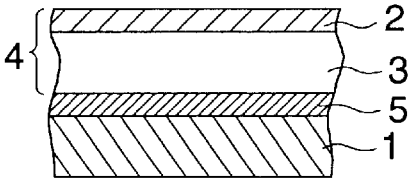
FIG. 1 (9)
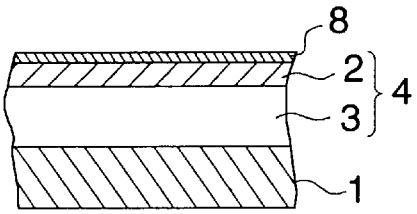

ELECTROPHOTOGRAPHIC PHOTORECEPTOR, AN IMAGE FORMING METHOD, AN IMAGE FORMING APPARATUS, AND AN APPARATUS UNIT

FIELD OF THE INVENTION

The present invention relates to an electrophotographic photoreceptor, an image forming method employing said electrophotographic photoreceptor, an image forming apparatus and an apparatus unit removably attached to said image forming apparatus.

BACKGROUND OF THE INVENTION

Conventionally, inorganic photoreceptors comprised of inorganic photoconductive materials such as selenium, cadmium sulfide, amorphous silicon and the like have been employed. However, said inorganic photoreceptors have had many problems such that the production is complicated, many of them exhibit toxicity, and are not preferred from the viewpoint of environmental protection as well as health.

Accordingly, instead of the aforementioned inorganic photoconductors, research and development have been increasingly carried out for organic photoreceptors comprised of organic photoconductive materials, which are not toxic, are easily produced, and exhibit wide option for the selection. Of the aforementioned organic photoreceptors, a function separation type photoreceptor comprised of a charge generating layer (CGL) comprising a charge generating material and a charge transport layer (CTL) comprising a charge transport material (CTM) in this order is now in main stream. Further, digital imaging has been progressed in which an image is formed on said photoreceptor employing, for example, light from a light emitting diode, a laser beam, or the like. Being based on this, enhancement in image quality has been demanded.

However, the aforementioned organic photoreceptors have had problems in which the mechanical abrasion resistance is small and repeated charging and exposure readily result in fatigue deterioration, compared to inorganic photoreceptors.

Thus, as means to enhance the abrasion resistance of the aforementioned organic photoreceptor (hereinafter simply referred to as photoreceptor), are known methods in which a the polymerization degree of a binder resin is increased, filler is added to a binder resin, a solid lubricating agent such as polytetrafluoroethylene (PTFE) is added to the surface of a photoreceptor and a friction coefficient between the photoreceptor and the cleaning blade as a cleaning means is decreased, and the like.

SUMMARY OF THE INVENTION

The increase in polymerization degree of a binder resin and the addition of filler enhance the abrasion resistance of the photoreceptor when employed for repeated image formation, and the abraded amount of the photosensitive layer may be decreased. However, phenomena occur in which cleaning properties are degraded, and problems have occurred with the fatigue degradation of a photoreceptor due to filming, the reversing of a blade, and the like.

On the other hand, by applying the solid lubricating agent onto the surface of the photoreceptor, it is found that the cleaning properties are enhanced due to decrease in friction between the photoreceptor and the cleaning blade. However, problems have occurred in which the strength of the photosensitive layer decreases and no sufficient abrasion resistance is obtained.

An object of the present invention is to provide a photoreceptor which minimizes a decrease in the thickness of the photosensitive layer of said photoreceptor due to abrasion and exhibits excellent abrasion resistance when image formation is repeatedly carried out, and specifically is carried out at high speed, exhibits excellent cleaning properties, minimizes the variation of electric potential at an exposed and unexposed area, and consistently forms sharp and high density images without forming fog, and an image forming method as well as an image forming apparatus employing said photoreceptor, and a unit which is removably attached to the apparatus body of said image forming apparatus.

It has been discovered that the glass transition temperature (in ° C.) as well as the contact angle (in degree) of the surface layer of the photosensitive layer of a photoreceptor with respect to deionized water has a close relationship with the abrasion resistance as well as the cleaning properties of said photoreceptor when images are repeatedly formed.

The present invention and embodiments thereof will be described.

An electrophotographic photoreceptor which comprises an electrically conductive support having thereon a photosensitive layer in which the glass transition temperature of the surface layer of said photosensitive layer is at least 105° C. and the contact angle of said surface layer with respect to deionized water is at least 90°.

The glass transition temperature of the surface layer of the photosensitive layer is preferably at least 120° C. The contact angle of the same with respect to deionized water is preferably at least 97°.

The surface layer preferably comprises polycarbonate containing a Si atom or a F atom.

The viscosity average molecular weight of the polycarbonate is preferably at least 50,000.

Examples of preferred polycarbonates are copolymers having a structure unit represented by formula (1).

Formula (1)

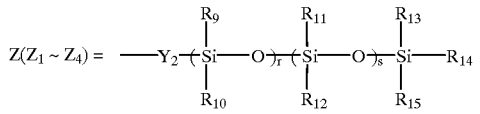

wherein $Y_1$ represents an alkylene group having from 1 to 6 carbon atoms or an alkylidene group, $R_1$ through $R_8$ each represents a hydrogen atom, a substituted or unsubstituted alkyl group having from 1 to 10 carbon atoms, or a substituted or unsubstituted aryl group, n represents an integer from 1 to 4, and the sum of p and q represents an integer of 1 to 200.

Examples of other preferred polycarbonates are copolymers having a structure unit represented by formula (2).

Formula (2)

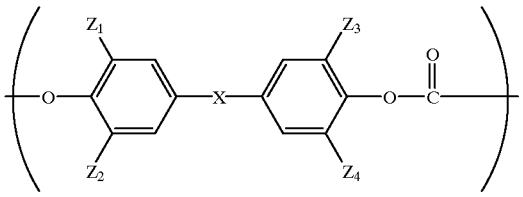

wherein X represents a straight chain or branched chain or a cyclic alkylidene group having from 1 to 15 carbon atoms, an alkylidene group substituted with an aryl group, an arylenediaklylidene group, —O—, —S—, —CO—, —SO—, or —$SO_2$—, and at least one of $Z_1$ through $Z_4$ represents a Si atom-containing group represented by formula (2') and each of others represents a hydrogen atom, an alkyl group having from 1 to 6 carbon atoms, and an aryl group.

Formula (2')

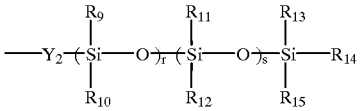

wherein $Y_2$ represents an alkylene group having from 1 to 6 carbon atoms or an alkylidene group, $R_9$ through $R_{15}$ each represents a substituted or unsubstituted alkyl group having from 1 to 10 carbon atoms, or a substituted or unsubstituted aryl group, and the sum of r and s represents an integer of 1 to 200.

The polycarbonates preferably have a F atom containing structural units in the copolymer structure or at the terminal.

An electrophotographic photoreceptor which comprises an electrically conductive support having thereon a photosensitive layer in which the glass transition temperature of the surface layer of said photosensitive layer is at least 105° C. and said surface layer comprises fine organic resin particles having a volume average particle diameter of no more than 5 $\mu$m.

Fine organic resin particles are preferably those containing a F atom.

The example of the surface layer is a charge transport layer. Said charge transport layer preferably comprises a charge transport material having a molecular weight of at least 750, and more preferably comprises the same having a molecular weight of at least 900.

The content of the charge transport material in the charge transport layer is preferably no more than 30 percent by weight.

An image may be formed on said photoreceptor by employing a latent image forming means which forms an electrostatic latent image, a transfer means which transfers the toner image on said electrophotographic photoreceptor visualized by development, and a cleaning means which removes the toner which remains on said electrophotographic photoreceptor after transferring the toner image.

In an image forming method, an electrostatic latent image may be formed on the electrophotographic photoreceptor which moves in a line speed of 400 mm/second, and may be subjected to development, transfer, and cleaning.

An electrophotographic photoreceptor may be applied to an apparatus unit which is integrally supported with at least one of a latent image forming means which forms an electrostatic latent image on said electrophotographic photoreceptor, a transfer means which transfers the toner image on said electrophotographic photoreceptor visualized by development, and a cleaning means which removes the toner which remains on said electrophotographic photoreceptor after transferring the toner image, and is removably mounted on the apparatus body.

BRIEF DESCRIPTION OF THE DRAWINGS

FIG. 1(1) to FIG. 1(9) are layer structures of photoreceptors.

DETAILED DESCRIPTION OF THE INVENTION

Figure 2:
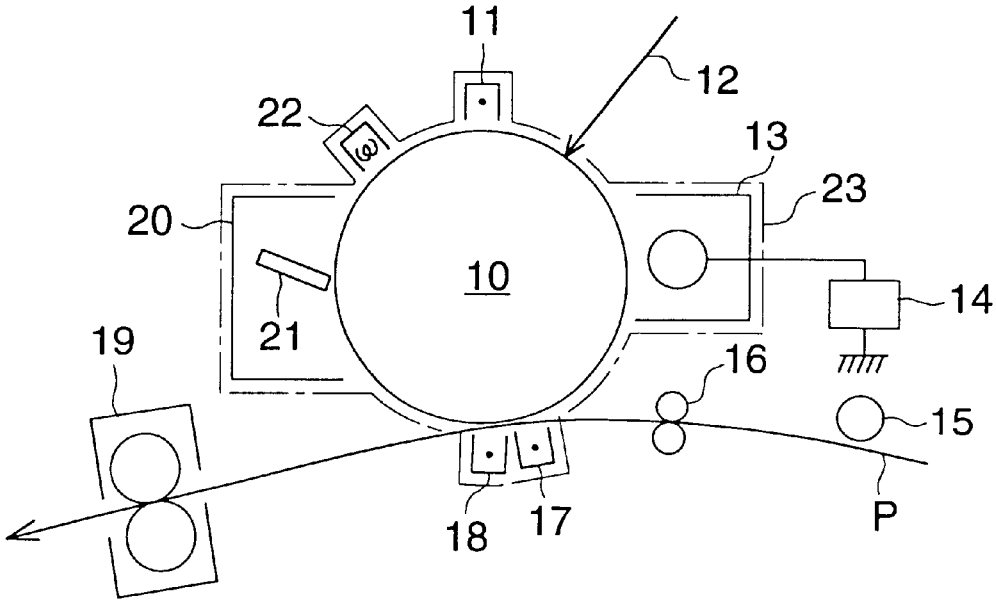
FIG. 2 is a view showing one example of an image forming apparatus.

In the following, the photoreceptor of the present invention, an image forming method employing said photoreceptor, an image forming apparatus and an apparatus unit will be detailed.

Photoreceptor

FIG. 1(1) to FIG. 1(9) each shows a layer structure of the photoreceptor of the present invention.

Herein, FIG. 1(1) and FIG. 1(2) each show a photoreceptor comprising photosensitive layer 4 having a multilayer structure in such a manner that a charge generating layer (CGL) 2 comprising a charge generating material (CGM) and a charge transport layer (CTL) 3 comprising a charge transport material (CTM) in this order are provided on an electrically conductive support 1. FIG. 1(3) and FIG. 1(4) show a photoreceptor in which CTL 3 of said photoreceptor is replaced with CTL 3-1 (an under layer CTL) and CTL 3-2 (an upper layer CTL) in a multilayer structure.

Furthermore, FIG. 1(5) and FIG. 1(6) show a photoreceptor in which single-layer structured photosensitive layer 4 comprising both CGM and CTM is provided on electrically conductive support 1. FIG. 1(7) through FIG. 1(9) show a photoreceptor having a multilayer structure in such a manner that CTL 3 and CGL 2 in this order are provided on electrically conductive support 1. Further, in FIG. 1(1) to FIG. 1(9), reference numeral 5 is an interlayer provided between said photosensitive later 4 and said electrically conductive support 1, if desired, and 8 is a protective layer provided on said photosensitive layer 4, if desired.

The important photoreceptors of the present invention are those (for negative charging) which are structured in multilayer as shown in FIG. 1(1) to FIG. 1(4). In the following, the photoreceptors shown in FIG. 1(1) to FIG. 1(4) will be mainly described. Accordingly, the surface layer of the photosensitive layer as described hereinafter means CTL 3 of (1) and (2) in FIG. 1 or CTL 3-2 of FIG. 1(3) and FIG. 1(4).

Photoreceptor (3)

As described above, the important photoreceptors (1) are those (for the use of negative charging) which are structured in multilayer as shown in FIG. 1(1) to FIG. 1(4). The surface layers (CTL 3 of (1) and (2) in FIG. 1 or CTL 3-2 of FIG. 1(3) and FIG. 1(4) have a glass transition temperature of at least 105° C. and a contact angle with respect to deionized water of at least 90°. When the surface layer of the photosensitive layer has a glass transition temperature of at least 105° C., appropriate physical properties of the photosensitive layer as well as abrasion resistance are obtained, and the decrease in the layer thickness due to abrasion is minimized during the repeated image formation. Further, when the surface layer of the photosensitive layer has a contact angle with respect to deionized water of at least 90°, the suitable surface energy of said photosensitive layer is obtained and the sufficient abrasion resistance is also obtained. Further, the photosensitive layer is sufficiently cleaned by a cleaning means (specifically a cleaning blade). Thus, it is possible to minimize the fatigue degradation of the photoreceptor during repeated image formation. In order to further reduce the decrease in the layer thickness of the photosensitive layer due to abrasion and to improve the cleaning properties, the surface layer of the photosensitive layer of said photoreceptor (1) preferably has a glass transition temperature of at least 120° C., and preferably has a contact angle with respect to deionized water of at least 97°.

The glass transition temperature (in ° C.) of the surface layer of the aforementioned photosensitive layer is measured employing differential thermal analysis.

Measurement apparatus: 7 Series Thermal Analysis System (manufactured by Perkin-Elmer Co.)

Heating rate: 10° C./minute

Measurement temperature range: 0 to 200° C.

Furthermore, the contact angle with respect to deionized water of the surface layer of the aforementioned photosensitive layer is measured by a liquid drop method employing a contact angle meter "CA-DT-A type" (manufactured by Kyowa Kaimen Kagaku Co., Ltd.).

Further, in photoreceptor (1), the glass transition temperature of the surface layer of said photoreceptor is at least 105° C., and is preferably at least 120° C. In order that the contact angle of said surface layer with respect to deionized water is at least 90°, and is preferably at least 97°, said surface layer preferably comprises as the main component of the binder resin polycarbonate (may be referred to as polycarbonate copolymer) comprised of a copolymer which has a composition unit comprising a Si atom or a F atom and further has a composition unit generally comprising neither a Si atom nor a F atom. Of particular, the viscosity average molecular weight of said polycarbonate copolymer is preferably at least 50,000, and is more preferably 300,000. When the viscosity average molecular weight of said polycarbonate is at least 50,000, the sufficient strength of the surface layer of the photosensitive layer is obtained. As a result, during repeated image formation, the decrease in the layer thickness due to abrasion is minimized and the deterioration of electrophotographic properties of the photoreceptor may be prevented. Further, when the viscosity average molecular weight of the polycarbonate is below 300,000, a photosensitive composition to form the photosensitive layer may be readily subjected to uniform coating.

The viscosity average molecular weight of the aforementioned polycarbonate copolymer is measured as described below.

A dichloromethane solution containing 6.0 g/liter of a polycarbonate copolymer sample is prepared. The ηSP of the resulting solution is measured at 20° C. employing an Ostwald-Fenske type viscometer. The viscosity average molecular weight is then obtained employing the following formula.

$$\eta SP/C=[\eta](1=K'\eta SP)$$

$$[\eta]=K(Mv)\alpha$$

wherein C is the polymer concentration (in g/liter), K' is 0.28, K is $1.23\times10^{-3}$, α is 0.83, [η] is the limiting viscosity, and Mv is the viscosity average molecular weight.

The polycarbonate copolymer which is incorporated in the surface layer of the photosensitive layer of photoreceptor (1) as the main component of the binder resin is generally composed of a structure unit containing a Si atom represented by the aforementioned general formulas (1) and (2) or one type or a plurality of types of composition units containing a F atom in the structure or the terminal described below, and another composition unit containing neither a Si atom nor a F atom, as described below. The content of the composition unit containing a Si atom or a F atom in said copolymer is preferably at least 1 percent by weight and less than 50 percent by weight. Accordingly, the content of the composition unit containing neither a Si atom nor a F atom is preferably in the range of 50 to 99 percent by weight. When the content of the composition unit containing a Si atom or a F atom in the polycarbonate copolymer contained as the main component of the aforementioned resin is less than 1 percent by weight and the content of the composition unit containing neither a Si atom nor a F atom exceeds 99 percent by weight, the contact angle (in degree) of the surface layer of the photosensitive layer with respect to deionized water decreases and the cleaning properties tend to be degraded. Furthermore, when the content of the composition unit comprising a Si atom or a F atom exceeds 50 percent by weight, and thus the content of the composition unit comprising neither a Si atom nor a F atom is less than 50 percent by weight, the physical properties of the surface layer of the photosensitive layer are degraded and the layer thickness due to abrasion tends to decrease.

The binder resin comprising the aforementioned polycarbonate copolymer as the main component may comprise other resins containing neither a Si atom nor a F atom upon being mixed as described below.

Further, photoreceptor (1) has a feature in which the surface layer of said photoreceptor (1) comprises a polymeric CTM together with a binder resin having as the main component a polycarbonate copolymer comprising a structure unit represented by the aforementioned general formulas (1) or (2), or a structure unit containing a Si atom in the structure or at the terminal and another structure unit containing no F atom. Said polymeric CTM will be described below.

In the following, specifically described will be the structure unit (the structure unit containing a Si atom) represented by the aforementioned general formulas (1) and (2), and the structure unit containing a F atom in its structure or at its terminal and another structure unit containing neither a Si atom nor a F atom.

Description of Formula (1)

In the formula (1), $Y_1$ represents an alkylene group having from 1 to 6 carbon atoms or an alkylidene group, $R_1$ through $R_8$. each represents a hydrogen atom, a substituted or unsubstituted alkyl group having from 1 to 10 carbon atoms, or an aryl group such as a substituted or unsubstituted phenyl group, a naphthyl group or the like, n represents an integer of 1 to 4, and the sum of p and q represents an integer of 1 to 200.

Examples of preferred compounds represented by the formula (1) will be illustrated.

(1-1)
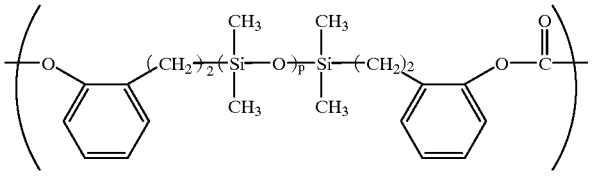
(1-2)
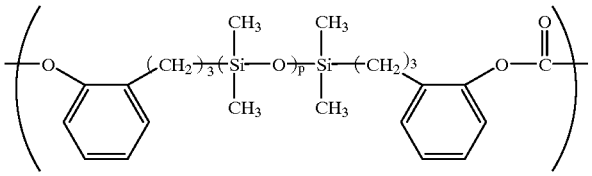
(1-3)
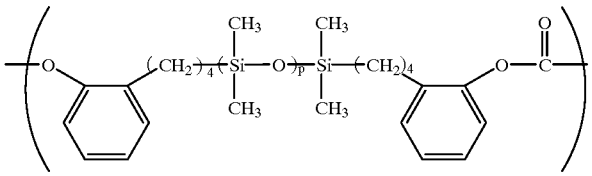
(1-4)
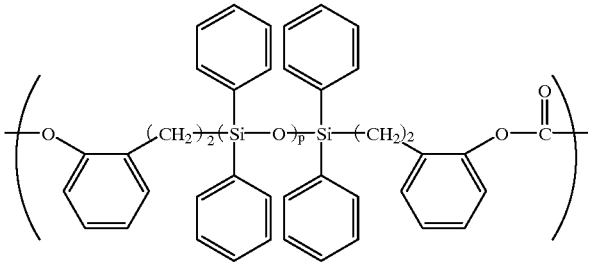
(1-5)
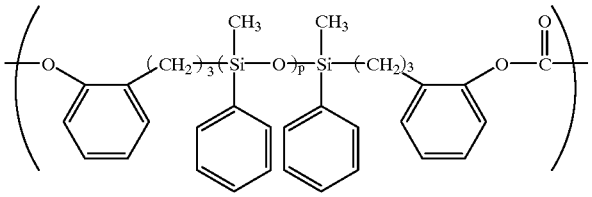
(1-6)
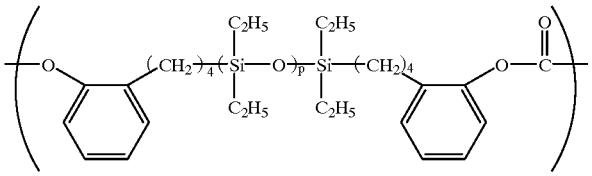
(1-7)
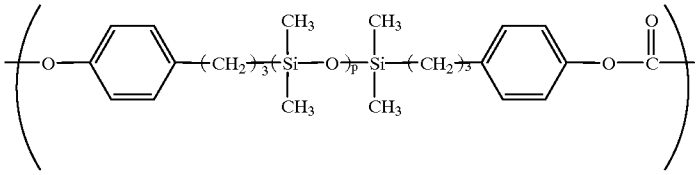
Note: P in the above Compound Examples (1-1) through (1-7) represents an integer of 1 to 200.

-continued (1-8)

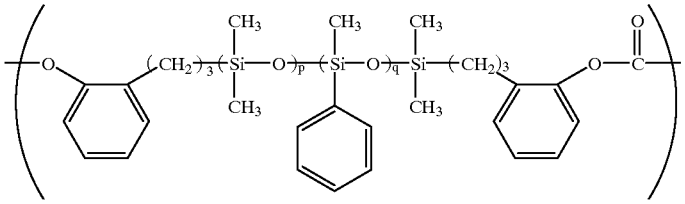

Note: the sum of p and q in the above Compound Example (1-8) represents an integer of 1 to 200.

Description of Formula (2)

In the formula (2), X represents a single bond alkylidene group, or a straight chain, branched chain, or cyclic alkylidene group having from 1 to 15 carbon atoms, an alkylidene group substituted with an aryl group such as a phenyl group, a naphthyl group, and the like, an arylenedialkylidene group substituted with an aryl group such as a phenyl group, a naphthyl group, and the like, —O—, —S—, —CO—, —SO—, or —$SO_2$—, at least one of $Z_1$ through $Z_4$ represents a Si atom containing group represented by the formula (2') and the other represent a hydrogen atom, an alkyl group having from 12 to 6 carbon atoms, an aryl group such as a phenyl group, a naphthyl group, and the like.

In the formula (2'), $Y_2$ represents an alkylene group having from 1 to 6 carbon atoms, or an alkylidene group, $R_9$ through $R_{15}$ each represents a substituted or unsubstituted alkyl group having from 1 to 10 carbon atoms or an aryl group such as a phenyl group, a naphthyl group, and the like, and the sum of r and s represents an integer of 1 to 200.

Examples of preferred compounds represented by the formula (2) are illustrated.

(2-1)

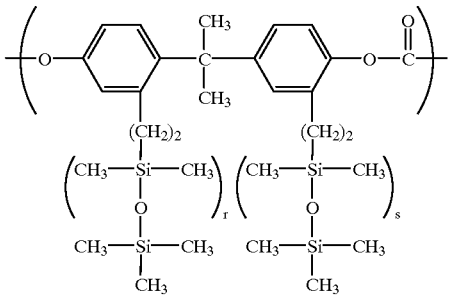

(2-2)

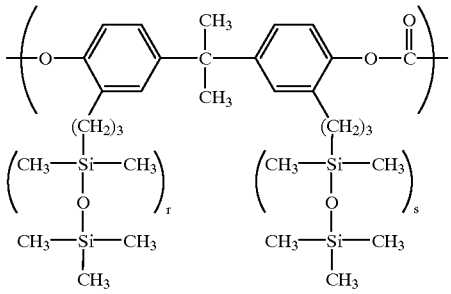

-continued (2-3)

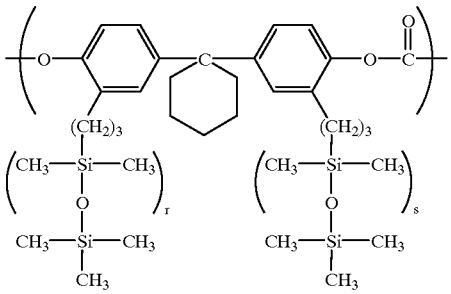

(2-4)

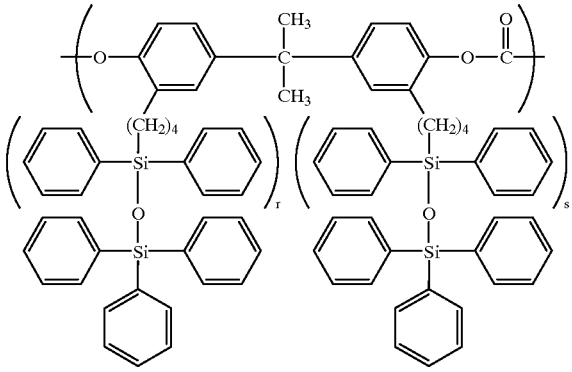

The sum of r and s in Compound Examples (2-1) through (2-4) represents an integer of 1 to 200.

(2-5)

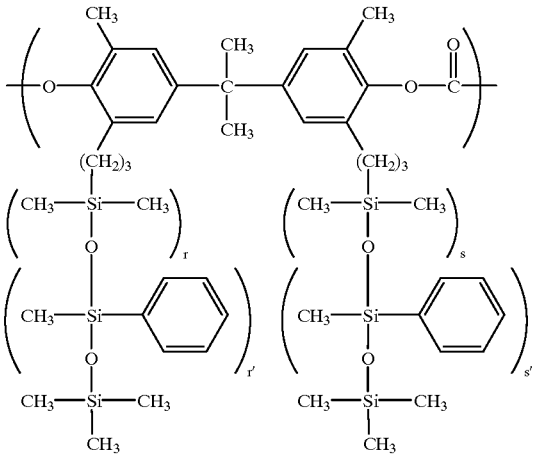

-continued

The sum of r and r′ and the sum of s and s′ in Compound Example (2-5) each represents an integer of 1 to 200.

Polycarbonate copolymers having structure units represented by the formulas (1) and (2), or a structure unit containing a F atom in the structure or at the terminal described below and a structure unit containing nether a Si atom nor a F atom in the structure described below may be synthesized by allowing an carbonate forming compound to react with divalent phenol or divalent naphthol containing a F atom or a Si atom in the structure which is a corresponding monomer, and divalent phenol or divalent naphthol containing neither a F atom nor a Si atom. Aforementioned synthesis methods includes those, for example, in which phosgene is employed as the carbonate forming compound and corresponding divalent phenol or divalent naphthol undergoes condensation polymerization in the presence of a suitable acid bonding agent, or bisaryl carbonate is employed as the aforementioned carbonate forming compound and corresponding divalent phenol or divalent naphthol undergoes condensation polymerization in the presence of a suitable acid bonding agent. Such reactions are carried out in the presence of a terminal reaction stopping agent and a branching agent, if desired.

Structure Unit Containing a F atom in the Structure or at the Terminal

Examples are illustrated which are structure units containing a F atom in the structure, and structure units containing a F atom at the terminal, which may be contained as a copolymerization component of the polycarbonate copolymer employed in the photosensitive layer of the photoreceptor (1).

(3-1)

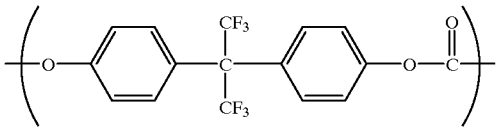

(3-2)

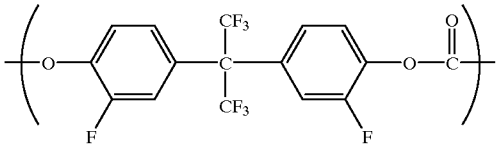

-continued (3-3)

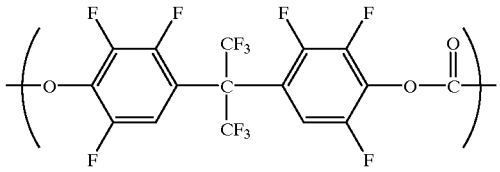

(3-4)

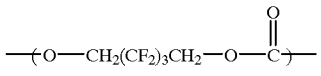

(3-5)

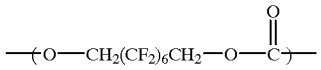

(3-6)

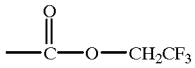

(3-7)

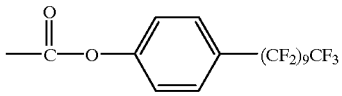

(3-8)

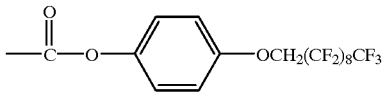

Structure Unit Containing neither a Si Atom nor a F Atom on the Structure

Examples are illustrated which are structure units containing neither a Si atom nor a F atom in the structure, generally incorporated as a copolymerization component to constitute a polycarbonate copolymer employed in the photosensitive layer of the photoreceptor (1).

(4-1)

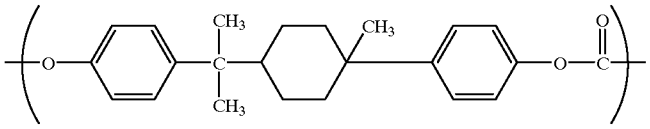

(4-2)

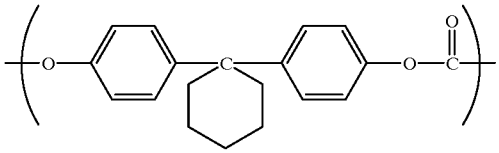

-continued
(4-3)
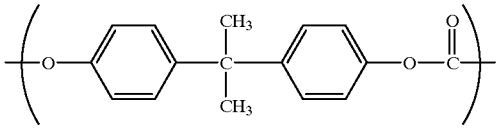
(4-4)
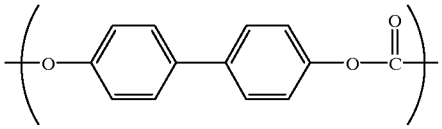
(4-5)
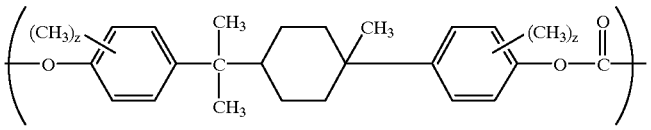
(4-6)
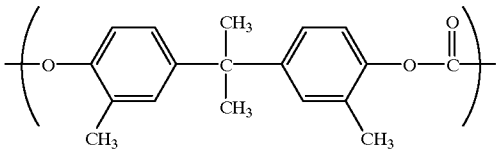
(4-7)
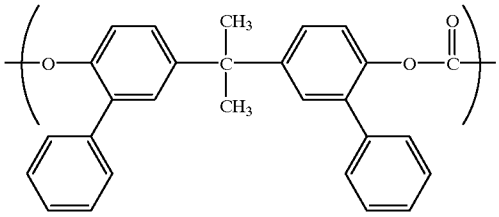
(4-8)
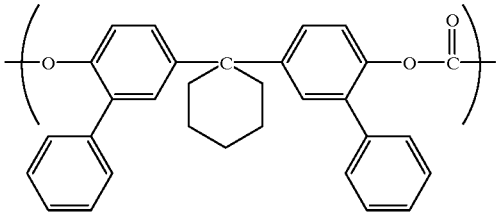
(4-9)
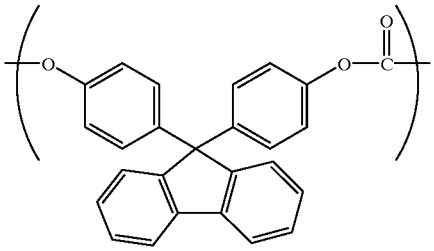
(4-10)
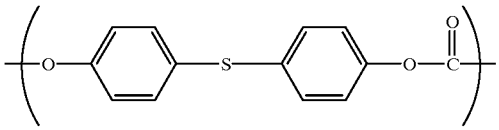

-continued
(4-11)
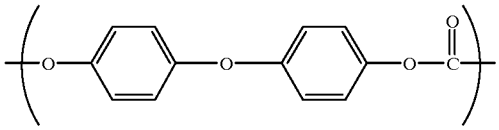
(4-12)
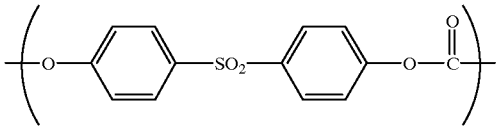
(4-13)
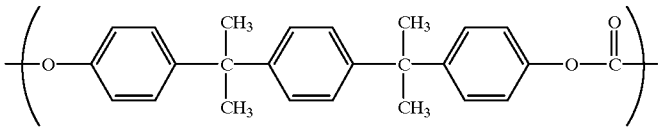
(4-14)
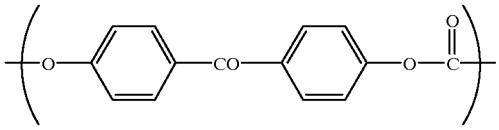
(4-15)
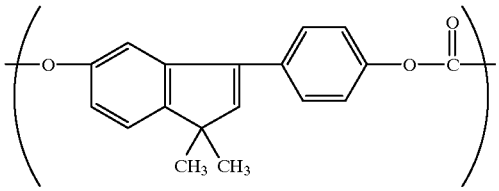
(4-16)
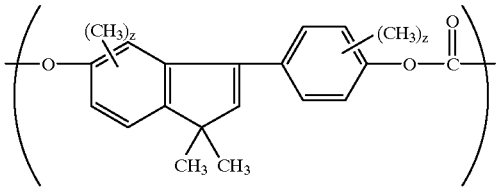
(4-17)
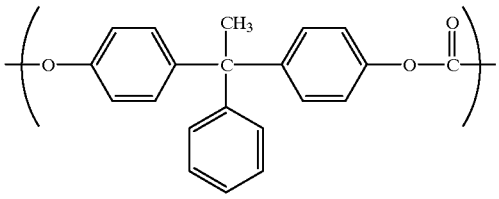
(4-18)
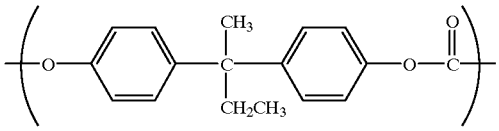
(4-19)
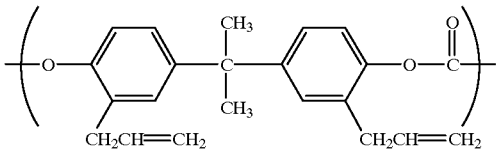

-continued (4-20)

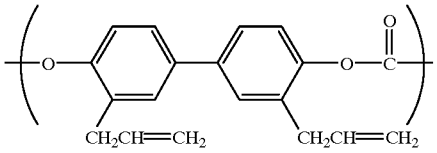

Z in Compound Examples (4-5) and (4-16) represents an integer of 1 to 6.

Other Binder Resins

Employed as binder resins which may be employed together with the polycarbonate copolymer employed in the photosensitive layer of the photoreceptor 1 of the present invention may be film forming high molecular weight polymers which are hydrophobic, have a high dielectric constant, and exhibit electrical insulation. Cited as examples may be polyesters, methacrylic acid resins, acrylic resins, polyvinyl chloride, polyvinylidene chloride, polystyrene, polyvinyl acetate, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol formaldehyde resins, styrene-alkyd resins, poly-N-vinyl carbazole, polyvinyl butyral, polyvinyl formal and the like.

Photoreceptor (2)

In the case of photoreceptor (2), the photoreceptors in the multilayer structure shown in FIG. 1(1) to FIG. 1(4) are mainly employed. The glass transition temperature of the surface layer (CTL 3 or CTL 3-2 in FIG. 1(1) to FIG. 1(4)) of the photosensitive layer of said photoreceptor (2) is at least 105° C. When the glass transition temperature of the surface layer of the photosensitive layer of said photoreceptor (2) is at least 105° C., appropriate physical properties as well as sufficient abrasion resistance of the photosensitive layer is obtained and the decrease in the layer thickness due to abrasion is minimized. Furthermore, the surface layer of the photosensitive layer of the photoreceptor (2) of the present invention comprises fine organic particles having a volume average particle diameter of no more than 5 μm. In order to minimize cleaning problems during the cleaning process such as insufficient cleaning and the like, and to prevent the damage of a cleaning member such as a cleaning blade and the like, the volume average particle diameter is preferably no more than 5 μm.

Preferably employed as fine organic particles are fine silicone resin particles, fine F atom-containing organic resin particles, fine melamine resin particles, and the like. Specifically, the fine F atom-containing resin particles are preferably employed. Employed as the fine F atom-containing resin particles are polymers which are prepared by employing monomers such as ethylene tetrafluoride, ethylene trifluoro chloride, ethylene hexafluoride propylene, vinyl fluoride, vinylidene fluoride, ethylene difluorochloride, trifluoropropylmethylsilane, and the like and copolymers thereof. Specifically ethylene tetrafluoride polymers as well as copolymers thereof are preferably employed.

The average particle diameter of fine organic particles is preferably between 0.01 and 5 μm, and the content of said fine organic particles incorporated into the surface layer of the photosensitive layer is preferably between 10 and 100 weight parts per 100 weight parts of the solid portion of said surface layer.

Employed as binder resins to form the surface layer (FIG. 1(1) and FIG. 1(2), or CTL 3 of FIG. 1(3) and CTL 3-2 of FIG. 1(4) of the photosensitive layer of the photoreceptor (2) are those generally employed for electrophotography, for example, other binder resins in the surface layer of the photosensitive layer of the aforementioned photoreceptor (1). The polycarbonate copolymer having a structure unit containing a Si atom or a F atom described in the aforementioned photoreceptor (1) may be employed. Employed as binder resins to form CTL 3-1 in the layer structure of FIGS. 1(3) and 1(4) are those generally used for electrophotography, for example, other binder resins in the surface layer of the photosensitive layer of the aforementioned photoreceptor (1). If desired, the polycarbonate copolymer having a composition unit containing a Si atom or a F atom described in the aforementioned photoreceptor (1).

CTL of Photoreceptors (1) and (2)

In the photoreceptor (1) and (2), as the CTL forming the surface layer of the photosensitive layer is important FIG. 1(1) and CTL 3 of FIG. 1(2) or FIG. 1(3) and CTL 3-2 are important. In said CTL 3 or CTL 3-2, polymeric CTM having a molecular weight of at least 750 is preferably incorporated as CTM, and the same having a molecular weight of at least 900 is more preferably incorporated.

As described above, by preferably incorporating a polymeric CTM into the surface layer of the photosensitive layer of photoreceptors (1) and (2) as the major component, the glass transition temperature (in ° C.) of CTL 3 or CTL 3-2 forming the surface layer becomes higher, physical properties of the said surface layer is improved, and the decrease in the layer thickness due to abrasion during the repeated image formation process is minimized. In addition, charges generated during light exposure move quickly to exhibit high sensitivity characteristics. Of particular, advantages are exhibited in such a manner that images can be formed at a high speed such as a linear speed of at least 400 mm/second, and the like.

Conventionally, in the electrophotographic industry, amorphous silicone based photoreceptors have been principally employed for high speed image formation such as a linear speed of at least 400 mm/second, due to problems with the delay in response of the photoreceptor to image exposure as well as difficulty in cleaning with the use of the blade cleaning system. However, said amorphous silicone based photoreceptors have originally had many problems such as difficulty in machining, high cost, and the like. Contrary to this, organic photoreceptors exhibit advantages such as ease in machining and low coat as well as wide range of selection to meet objectives, and the like. In the present invention, by employing an organic photoreceptor having a surface layer comprising polymeric CTM which has a particular low surface energy as described and makes it possible to achieve high sensitivity, high durability as well as high speed response properties at a surface linear speed of at least 400 mm/second may provided with said photoreceptor and the cost may be markedly reduced compared to aforementioned amorphous silicone based photoreceptor.

Preferably employed as the aforementioned polymeric CTM (and comparative CTM) are compounds illustrated below.
CTM-1
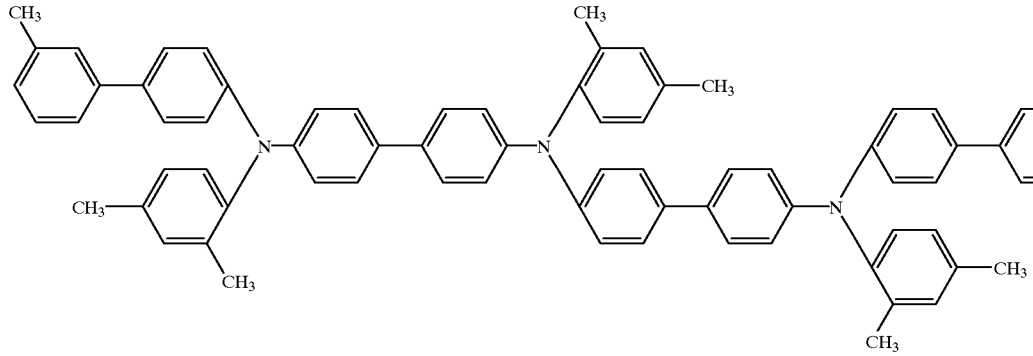
Mw = 995
(121° C.)
CTM-2
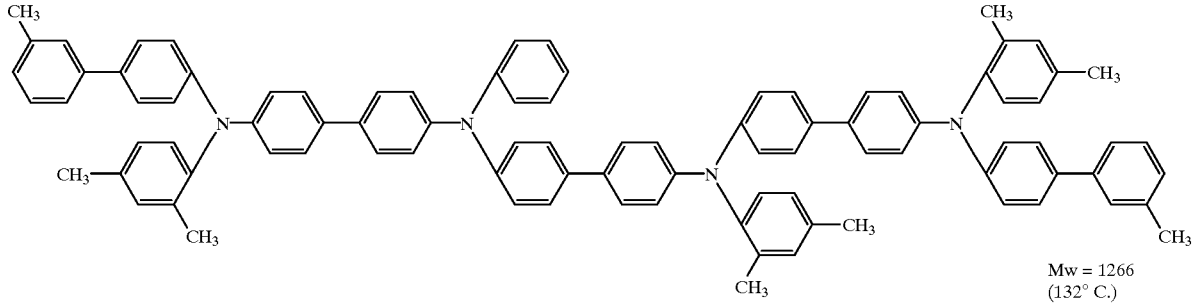
Mw = 1266
(132° C.)
CTM-3
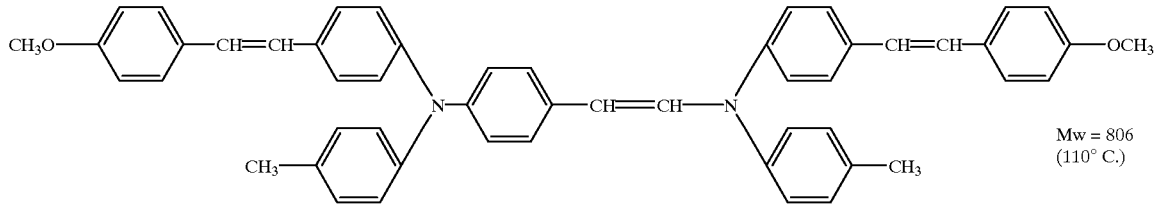
Mw = 806
(110° C.)
CTM-4
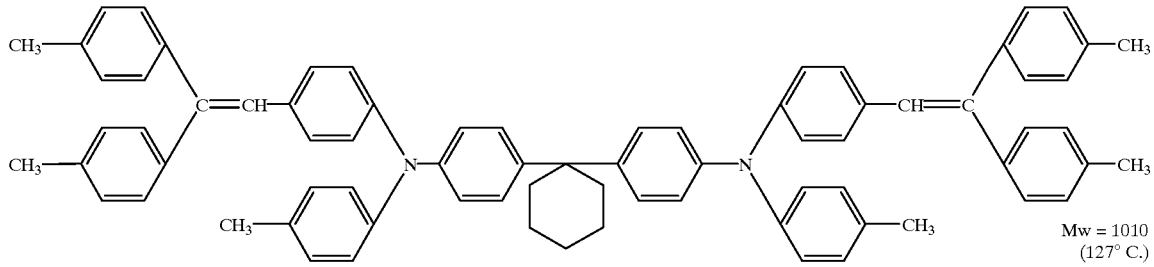
Mw = 1010
(127° C.)

-continued

CTM-5

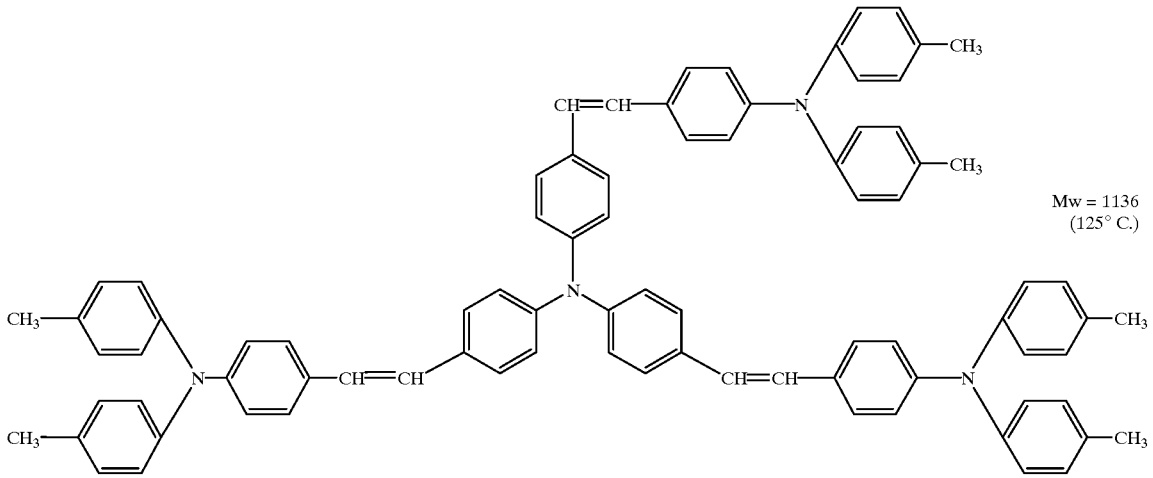

Mw = 1136
(125° C.)

CTM-6

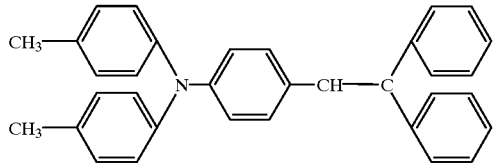

(for comparison)

Mw = 452
(78° C.)

In order to exhibit excellent physical layer properties as well as high sensitivity characteristics, the content of the aforementioned polymeric CTM incorporated in the surface layer of the photosensitive layer of photoreceptors (1) and (2) is preferably at least 50 percent by weight of the entire CTM incorporated in said surface layer. The surface layer of the photosensitive layer of photoreceptors (1) and (2) may comprise other CTM in an amount of less than 50 percent by weight, if desired. When photoreceptors (1) and (2) are composed of CTL 3-1 and CTL 3-2 in a multilayer structure as shown in FIG. 1(3) and FIG. 1(4), listed as CTMs incorporated in CTL 3-1 are, for example, carbazole derivatives, oxazole derivatives, thiazole derivatives, oxadiazole derivatives, thiadiazole derivatives, triazole derivatives, imidazole derivatives, imidazolone derivatives, imidazolidine derivatives, bisimidazolidine derivatives, styryl compounds, hydrazone compounds, pyrazoline derivatives, oxazolone derivatives, benzimidazole derivatives, quinazoline derivatives, benzofuran derivatives, acridine derivatives, phenazine derivatives, aminostilbene derivatives, triarylamine derivatives, phenylenediamine derivatives, stilbene derivatives, benzidine derivatives, poly-N-vinylcarbazole, poly-1-vinylpyrene, poly-9-vinylanthracene, and the like. Further, these CTMs may be employed individually or in combination, and may comprise the aforementioned CTM.

In order to obtain preferred physical layer properties, to minimize the decrease in layer thickness due to abrasion during repeated image formation, and to minimize the degradation of electrophotographic performance, the content of CTM incorporated in the surface layer of the photosensitive layer of photoreceptors (1) and (2) is preferably below 30 percent by weight of CTL 3 or CTL 3-2 forming the surface layer. In photoreceptors (1) and (2), polymeric CTM is employed in CTL 3 or CTL 3-2 forming the surface layer of the photosensitive layer. As a result, when said CTM is incorporated in the surface layer in an amount of no more than 30 percent by weight, sufficient sensitivity characteristics may be exhibited. The content of CTM in the surface layer is preferably at least 1 percent by weight in order to obtain necessary sensitivity characteristics of the photosensitive layer.

When photoreceptors (1) and (2) are comprised of CTL 3-1 and CTL 3-2 in a multilayer structure as shown in FIG. 1(3) and FIG. 1(4), the content of CTM incorporated in CTL 3-1 is preferably between 1 and 40 percent by weight.

When the layer of photoreceptors (1) and (2) is structured as shown in FIG. 1(1) and FIG. 1(2), the layer thickness of CTL 3 is preferably between 5 and 40 $\mu$m. Further, the layer of photoreceptors (1) and (2) is structured as shown in FIG. 1(3) and FIG. 1(4), the layer thickness of CTL 3-2 is preferably between 1 and 20 $\mu$m, and the layer thickness of CTL 3-1 is preferably between 5 and 30 $\mu$m.

CGL of Photoreceptors (1) and (2)

The important layer structures of the photoreceptors (1) and (2) are those shown in FIG. 1(1) through FIG. 1(4). In the structures shown in FIG. 1(1) through FIG. 1(4), CGL 2 is provided under the aforementioned CTL 3 (or CTL 3-1) via interlayer 5, if desired, on electrically conductive layer 1. Employed as CGMs incorporated in the aforementioned CGL 2 are, for example, azo based dyes, perylene based dyes, indigo based dyes, cyclic quinone based dyes, quinacridone based dyes, bisbenzimidazole based dyes, indanthron based dyes, squarilium based dyes, metal phthalocyanine based dyes, metal free phthalocyanine based dyes, pyrylium salt based dyes, thiapyrylium salt based dues, and the like.

The aforementioned CGL may be formed employing the method described below.

(1) Vacuum deposition method (2) Method to coat a solution prepared by dissolving CGM in a suitable solvent (3) Method to coat a dispersion obtained by pulverizing CGM into fine particles in a dispersion medium employing a ball mill, sand grinder, and the like, and if desired, by mixing the resulting fine particles with a binder resin and dispersing the resulting mixture.

Namely, specifically, employed may optionally be gas phase lamination methods such as such as vacuum deposition, sputtering, CVD, and the like, or coating methods such as dipping, spray, roll, and the like. The thickness of CGL 2, formed as described above, is preferably between 0.01 and 5 μm, and is more preferably between 0.05 and 3 μm. Said CGL 2 is formed by dispersing CGM 1 in fine particles in an amount of no more than 1 weight part into a binder resin in an amount of no more than 5 weight parts.

Employed as the aforementioned binder resin is a resin similar to one employed in the aforementioned CTL 3.

Photosensitive layer 4 (CGL 2 and/or CTL 3) may comprise, in addition to the aforementioned CTM as well as CGM, antioxidants, electron accepting materials and the like, if desired.

Antioxidants

With the purpose of minimizing degradation due to ozone, antioxidants may be incorporated into the photosensitive layer of the photoreceptor. Cited as antioxidants may be hindered phenol, hindered amine, paraphenylenediamine, arylalkane, hydroquinone, spirochroman, spiroindanone, and derivatives thereof, organic sulfur compounds, organic phosphorous compounds, and the like.

Such specific compounds are described in Japanese Patent Publication Open to Public Inspection Nos. 63-15154, 63-18355, 63-44662, 63-50848, 63-50849, 63-58455, 63-71856, 63-71856, and 63-146046. The added amount of antioxidants is preferably between 0.1 and 100 weight parts per 100 weight parts of CTM, is more preferably between 1 and 50 weight parts, and is most preferably between 5 and 25 weight parts.

Electron Accepting Materials

With the purpose of the increase in sensitivity, the elevation of residual electric potential, and the decrease in fatigue during repeated use, the photosensitive layer of the photoreceptor may comprise at least one type of electron accepting materials.

The content of the aforementioned electron accepting materials is preferably 0.01 to 200% of CGM in terms of weight ratio.

The electron accepting material may be incorporated into CTL 3. The content of the electron accepting material in such a layer is preferably 0.01 to 100%, and is more preferably 0.1 to 50% of CTM in terms of weight ratio.

Listed as electron accepting materials may be, for example, succinic anhydride, maleic anhydride, dibromomaleic anhydride, phthalic anhydride, tetrachlorophthalic anhydride, tetrabromophthalic anhydride, 3-nitrophthalic anhydride, 4-nitrophthalic anhydride, pyromellitic anhydride, mellitic anhydride, tetracyanoethylene, tetracyanoquinodimethane, o-dinitrobenzene, m-dinitrobenzene, 1,3,5-trinitrobenzene, paranitrobenzonitrile, picryl chloride, quinonechloroimide, chloranil, bromanil, dichlorodicyanoparabenzoquinone, anthraquinone, dinitroanthraquinone, 2,7-dinitrofluorenone, 2,4,7-trinitrofluorenone, 2,4,5,7-tetranitrofluorenone, 9-fluorenylidene[dicyanomethylenemalonodinitrile], polynitro-9-fluorenylidene-[dicyanomethylenemalonodinitrile], picric acid, o-nitrobenzoic acid, p-nitrobenzoic acid, 3,5-dinitrobenzoic acid, pentafluorobenzoic acid, 5-nitrosalicylic acid, 3,5-dinitrosalicylic acid, phthalic acid, mellitic acid, others such as compounds having high electron affinity.

With the papoose of the improvement of the charge generating function of CGM, organic amines may be incorporated into photosensitive layer 4 of the photoreceptor or CGL 2, and specifically secondary amines are preferably incorporated.

Such compounds are described in Japanese Patent Publication Open to Public Inspection Nos. 59-218447, 62-8160, and the like.

In addition, with the purpose of protection of the photosensitive layer, UV absorbers and the like may be incorporated into said photosensitive layer 4 of the photoreceptor, and dyes for correcting spectral sensitivity may be incorporated.

Solvents or Dispersion Media for CGL 2 and CTL 3

Cited as solvents or dispersion media employed for the formation of the aforementioned CGL 2 are butylamine, diethylamine, ethylenediamine, isopropanolamine, triethanolamine, triethylenediamine, N,N-dimethylformamide, acetone, methyl ethyl ketone, cyclohexanone, benzene, toluene, xylene, chloroform, 1,2-dicholorethane, 1.2-dichloropropane, 1,1,2-trichloroethane, trichloroethylene, tetrachloroethane, dichloromethane, tetrahydrofuran, dioxane, methanol, ethanol, isopropanol, ethyl acetate, butyl acetate, dimethyl sulfoxide, methyl cellosolve, and the like. Further, the aforementioned CTL 3 may be prepared employing the same solvents as those for CGL 2.

Ancillary Layer

Further, in the aforementioned photoreceptor, protective layer 8 of said photoreceptor may be provided, if desired.

With the purpose of the improvements in machining properties as well as physical properties (minimization of cracks, providing of flexibility, and the like), plasticizers may be incorporated into the protective layer 8 in an amount of less than 50 percent by weight.

Interlayer 5 functions as an adhesive layer between electrically conductive support 1 and photosensitive layer 4, a blocking layer, or the like. Other than binder resins employed in the aforementioned CTL 3 or CGL 2, employed are, for example, polyvinyl alcohol, ethyl cellulose, carboxymethyl cellulose, vinyl chloride-vinyl acetate copolymers, vinyl chloride-vinyl acetate-maleic anhydride copolymers, casein, N-alkoxymethylated nylon, starch, and the like.

Image Forming Method, Image Forming Apparatus, and Apparatus Unit

Images are formed employing the aforementioned photoreceptors (1) or (2). Preferably, drum-shaped photoreceptors having layer structures FIG.1(1) through FIG. 1(4) are employed. Employed as an image forming apparatus is an electrophotographic copier equipped with, for example, any one of said photoreceptors, in which images are repeatedly formed at a high speed of preferably at least 400 mm/second employing image forming processes including charging, image exposure, development, transfer, fixing, cleaning, charge elimination, and the like.

FIG. 2 is one example of an image forming apparatus describing an image forming method. In FIG. 2, reference numeral 10 is a drum-shaped photoreceptor obtained by providing photosensitive layer 4 having CGL 2 and CTL 3 (may be formed employing CTL 3-1 and CTL 3-2 in a multilayer structure) in this order via, if required, interlayer 5 on electrically conductive base body 1. Photoreceptor (1) is employed in which the glass transition temperature of CTL 3 (CTL 3-2 in the multilayer structure) which is the surface layer of said photosensitive layer 4 is at least 105° C., and the contact angle of the same with respect to deionized water is at least 90°, or photoreceptor (2) is employed in which the glass transition temperature of said surface layer is at least 105° C., and said surface layer comprises fine organic particles having a volume average diameter of no more than 5 μm, preferably fine organic resin particles containing a F atom.

In FIG. 2, reference numeral 11 is a charging unit, 12 is image exposure, 13 is a development unit, 14 is a bias power source, 15 is a feeding roller, 16 is a timing roller, 17 is a transfer unit, 18 is a separation unit, 19 is a heat roller, 20 is a cleaning unit, 21 is a cleaning blade, and 22 is a charge eliminating unit.

In FIG. 2, the photoreceptor 10 is subjected to uniform charging on its surface employing the charging unit 11. Thereafter, an electrostatic latent image is formed by image exposure 12. Said electrostatic latent image is developed with the development unit 13 utilizing, for example, a magnetic brush system to form a toner image. The resulting toner image is fed by the feeding roller 15 and is transferred onto transfer paper P which has been conveyed in synchronization with the photoreceptor 10 by the timing roller 16 through the action of the transfer unit 17 as well as the separation unit 18, is separated, and fixed images are obtained by the action of the fixing unit 19.

A cleaning blade, employed in the image forming method and the image forming apparatus, is preferably a elastic rubber blade, and is most preferably a urethane rubber blade, which exhibits advantages such as simple structure, high durability, and excellent cleaning efficiency compared to conventional brush cleaning and the like.

The image processing methods and the image forming apparatuses may be those such as analogue copiers, digital copiers provided with a scanner, printers and copiers which form images in accordance with eternal image signals, or digital image forming apparatuses which perform functions for a copier as well as a printer. Further, they may be those for black-and-white as well as for color.

In the image forming methods and image forming apparatuses, an image forming apparatus which forms images employing a dot-shaped digital system preferably utilizes a reversal development system under non-contact. Of particular, during the formation of color images, bright and sharp color images are obtained.

In the image forming apparatus, it is preferable that an apparatus unit is integrally constituted by employing the drum shaped photoreceptor 10 together with at least one of image forming units such as the charging unit 11, the development unit 13, the transfer unit 17, the separation unit 18, the cleaning unit 20, and the precharging charge eliminating unit 22, and the resulting apparatus unit is removable attached to the apparatus main body. By removably attaching the drum-shaped photoreceptor 10 together with at least one of image forming units to the apparatus body, it becomes easy to maintain the apparatus, as well as to take corrective action against the formation of jamming. Generally, the apparatus unit is removably attached to the apparatus main body via guide rail and the like. Reference numeral 23 in FIG. 2 shows one example of the apparatus unit, which is mounted on the image forming apparatus. Herein, the aforementioned charging unit 11, development unit 13, transfer unit 17, separation unit 18, cleaning unit 20, and charge eliminating unit 22 are integrated with the photoreceptor 10, and the resulting integration is mounted on the apparatus body as the apparatus unit, while it is removably provided via a handle (not shown).

EXAMPLES

The present invention will be detailed with reference to examples below.

Example 1

The interlayer (also referred to as sublayer) coating composition as described below was prepared and was applied onto a drum-shaped electrically conductive aluminum base body having a diameter of 80 mm so as to obtain a dry layer thickness of 1.0 μm, and thus a sublayer was obtained.

| 1: Sublayer Coating Composition | |
|---|---|
| Titanium chelate compound "TC-750" (manufactured by Matsumoto Seiyaku Co., Ltd.) | 30 g |
| Silane coupling agent "KBM-503" (manufactured by Shin-Etsu Kagaku Kogyo Co., Ltd.) | 17 g |
| 2-Propanol | 150 ml |

The CGL coating composition described below was prepared through dispersion and was applied onto the aforementioned sublayer so as to obtain a layer thickness of 0. 5 μm. Thus CGL was obtained.

| 2: CGL Coating Composition | |
|---|---|
| Y-type titanyl phthalocyanine | 10 g |
| Silicone resin "KR-5240" (manufactured by Shin-Etsu Kagaku Kogyo Co., Ltd.) | 10 g |
| t-Butyl acetate | 1000 ml |

The aforementioned composition was dispersed for 20 hours employing a sand mill.

The CTL coating composition described below was applied onto the aforementioned CGL so as to obtain a dry layer thickness of 23 μm. Thereafter, the resulting coating was dried at 100° C. for one hour to obtain Example 1 photoreceptor provided with the CTL in the multilayer structure. The glass transition temperature (Tg) of the CTL of the resulting photoreceptor was 125° C., and the contact angle with respect to deionized water was 101°.

| 3: CTL Coating Composition | |
|---|---|
| CTM-5 | 224 g |
| Resin (B-1) (having an Mv of 30,000) | 560 g |
| Irganox 1010 (manufactured by Sankyo Co., Ltd.) | 21 g |
| 1.2-Dichloroethane | 2,800 ml |

Example 2

The photoreceptor of Example 2 was obtained in the same manner as Example 1, except that in Example 1, the CTL resin (B-1) (having an Mv of 30,000) was replaced with resin (B-2) (having an Mv of 30,000). The Tg of the CTL of the resulting photoreceptor was 114° C., and the contact angle of the same was 99°.

Example 3

The photoreceptor of Example 3 was obtained in the same manner as Example 1, except that in Example 1, the CTL resin (B-1) (having an Mv of 30,000) was replaced with resin (B-3) (having an Mv of 30,000). The Tg of the CTL of the resulting photoreceptor was 110° C., and the contact angle of the same was 98°.

Example 4

The photoreceptor of Example 4 was obtained in the same manner as Example 1, except that in Example 1, the CTL resin (B-1) (having an Mv of 30,000) was replaced with resin (B-4) (having an Mv of 30,000). The Tg of the CTL of the resulting photoreceptor was 113° C., and the contact angle of the same was 100°.

Example 5

The photoreceptor of Example 5 was obtained in the same manner as Example 1, except that in Example 1, the CTL resin (B-1) (having an Mv of 30,000) was replaced with resin (B-1) (having an Mv of 50,000). The Tg of the CTL of the resulting photoreceptor was 127° C., and the contact angle of the same was 101°.

Example 6

The photoreceptor of Example 6 was obtained in the same manner as Example 1, except that in Example 1, the CTL resin (B-1) (having an Mv of 30,000) was replaced with resin (B-5) (having an Mv of 30,000). The Tg of the CTL of the resulting photoreceptor was 121° C., and the contact angle of the same was 103°.

Comparative Example 1

The photoreceptor of Comparative Example 1 was obtained in the same manner as Example 1, except that in Example 1, the CTL resin (B-1) (having an Mv of 30,000) was replaced with bisphenol Z resin "X-3000" (manufactured by Mitsubishi Gas Kagaku Co. , Ltd. ) (having an Mv of 30,000). The Tg of the CTL of the resulting photoreceptor was 126° C., and the contact angle of the same was 85°.

Example 7

The CTL coating composition described below was applied onto the CGL of Example 1 so as to obtain a dry layer thickness of 23 μm. Thereafter, the resulting coating was dried at 100° C. for one hour to obtain the photoreceptor Example 7 provided with the CTL in the multilayer structure. The Tg of the CTL of the resulting photoreceptor was 121° C., and the contact angle with respect to deionized water was 101°.

| CTL Coating Composition | |
|---|---|
| CTM-1 | 224 g |
| Resin (B-1) (having an Mv of 30,000) | 560 g |
| Irganox 1010 (manufactured by Sankyo Co., Ltd.) | 21 g |
| 1.2-Dichloroethane | 2,800 ml |

Example 8

The photoreceptor of Example 8 was obtained in the same manner as Example 7, except that in Example 7, the CTM-1 was replaced with CTM-2. The Tg of the CTL of the resulting photoreceptor was 132° C., and the contact angle of the same was 103°.

Example 9

The photoreceptor of Example 9 was obtained in the same manner as Example 7, except that in Example 7, the CTM-1 was replaced with CTM-3. The Tg of the CTL of the resulting photoreceptor was 110° C., and the contact angle of the same was 100°.

Example 10

The photoreceptor of Example 10 was obtained in the same manner as Example 7, except that in Example 7, the CTM-1 was replaced with CTM-4. The Tg of the CTL of the resulting photoreceptor was 127° C., and the contact angle of the same was 100°.

Comparative Example 2

The photoreceptor of Comparative Example 2 was obtained in the same manner as Example 1, except that in Example 7, the CTM-1 was replaced with CTM-6. The Tg of the CTL of the resulting photoreceptor was 78° C., and the contact angle of the same was 100°.

Example 11

The CTL coating composition described below was applied onto the CGL of Example 1 so as to obtain a dry layer thickness of 23 μm. Thereafter, the resulting coating was dried at 100° C. for one hour to obtain the photoreceptor Example 11 provided with the CTL in the multilayer structure. The Tg of the CTL of the resulting photoreceptor was 118° C., and the contact angle with respect to deionized water was 101°.

| CTL Coating Composition | |
|---|---|
| CTM-5 | 224 g |
| Resin (B-1) (having an Mv of 30,000) | 560 g |
| Fine fluororesin particles "Ruburon L2: 0.2 μm" (manufactured by Daikin Kogyo, Ltd.) | 5.6 g |
| Irganox 1010 (manufactured by Sankyo Co., Ltd.) | 1.2 g |
| 1.2-Dichloroethane | 2,800 ml |

Example 12

The CTL coating composition described below was applied onto the CGL of Example 1 so as to obtain a dry layer thickness of 23 μm. Thereafter, the resulting coating was dried at 100° C. for one hour to obtain a photoreceptor. The Tg of the CTL of the resulting photoreceptor was 119° C., and the contact angle with respect to deionized water was 101°.

| CTL Coating Composition | |
|---|---|
| CTM-5 | 224 g |
| Bisphenol Z resin "Z-300" (manufactured by Mitsubishi Gas Kagaku Co., Ltd.) (having an Mv of 30,000) | 560 g |
| Fine fluororesin particles "Ruburon L2: 0.2 μm" (manufactured by Daikin Kogyo, Ltd.) | 5.6 g |
| Fine fluororesin particles "GF-300" (manufactured by Toa Gosei Co., Ltd.) | 0.5 g |
| Irganox 1010 (manufactured by Sankyo Co., Ltd.) | 1.2 g |
| 1.2-Dichloroethane | 2,800 ml |

Comparative Example 3

A photoreceptor was obtained in the same manner as Example 12, except that in Example 12, the CTM-5 was replaced with CTM-6. The Tg of the CTL of the resulting photoreceptor was 75° C., and the contact angle of the same was 99°.

The chemical structures of resins (B-1) through (B-5) employed in the CTL of the aforementioned Examples 1 through 11 are illustrated below.

(B-1)

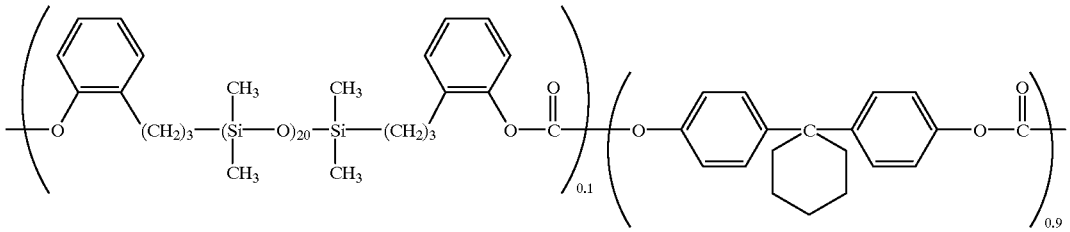

(B-2)

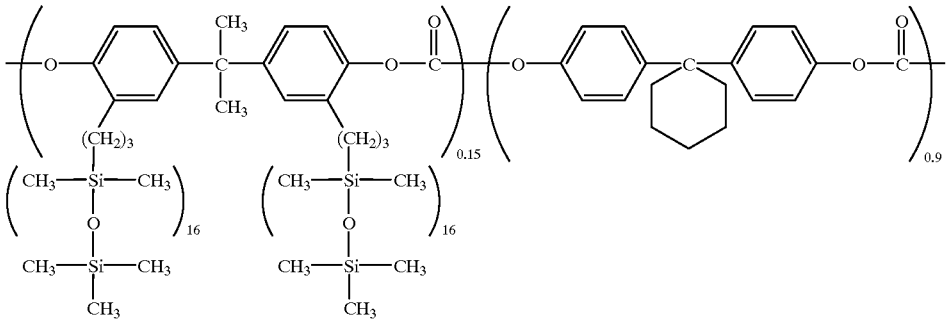

(B-3)

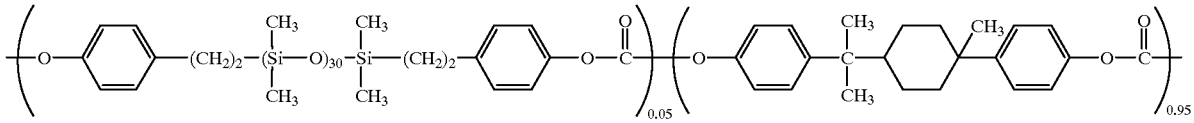

(B-4)

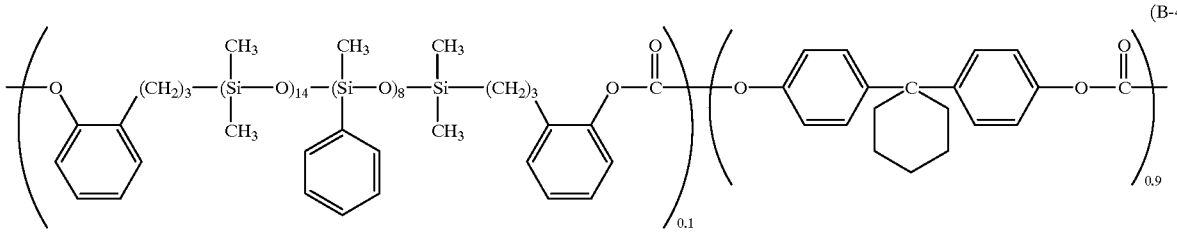

(B-5)

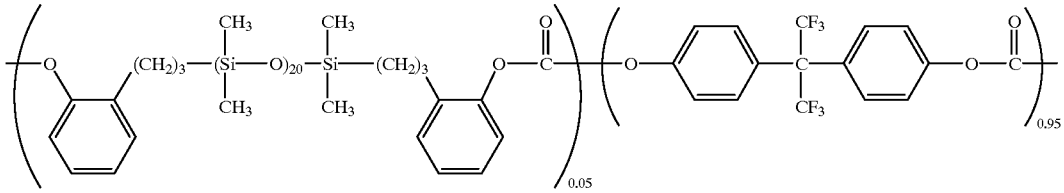

<Evaluation>

Each of 15 types of photoreceptors obtained as described above was installed in a digital copier Konica 7060 (in which the photoreceptor was integrally united with the charging unit, development unit, cleaning unit, and charge eliminating unit) and the characteristics of the photoreceptor described below were evaluated.

The aforementioned copier was modified and a surface electrometer was provided. The process consisting of charging, exposure, and charge elimination was repeated 5,000 times, and the electric potential fluctuation, $\Delta V_H(V)$ of an unexposed area, as well as the electric potential fluctuation, $\Delta V_L(V)$ of an exposed area, was measured. Table 1 shows the results.

Subsequently, an elastic rubber blade, having a rubber hardness of JIS A 65°, an impact resilience of 40 percent, a thickness of 2 mm, and a free length of 9 mm, was brought into contact with a rotating photoreceptor at a contact angle of 20° in the counter direction against rotation direction under a pushing pressure of 13 g/cm, and 50,000 sheets were practically copied. Resulting image quality was evaluated. After copying 50,000 sheets, the decrease in the layer thickness due to abrasion was measured and a halftone image (the formation of spot defects and image unevenness) was visually evaluated. Table 1 shows the results.

Further, the aforementioned decrease in the layer thickness due to abrasion was obtained by measuring the difference between the initial layer thickness and the layer thickness after copying 50,000 sheets. The layer thickness of randomly selected ten spots over the uniform thickness portion of a sheet was measured and averaged. The average was denoted as the layer thickness of a photoreceptor. The layer thickness was measured by a layer thickness measuring meter "EDDY 560C" (manufactured by Helmut Fischer GMBHT Co.)

TABLE 1

| Embodiment | Properties of Surface Layer: Tg (° C.) | Properties of Surface Layer: Contact Angle (°) | Electric Potential Properties: $\Delta V_H$ (V) | Electric Potential Properties: $\Delta V_L$ (V) | Decrease in Layer Thickness (μm) | Image Evaluation: Cleaning Properties | Remarks |
|---|---|---|---|---|---|---|---|
| Example 1 | 125 | 101 | 24 | 38 | 1.45 | good | Inv. |
| Example 2 | 114 | 99 | 27 | 37 | 2.18 | good | |
| Example 3 | 110 | 98 | 31 | 42 | 2.24 | good | |
| Example 4 | 113 | 100 | 24 | 37 | 2.00 | good | |
| Example 5 | 127 | 101 | 24 | 43 | 0.98 | good | |
| Example 6 | 121 | 103 | 28 | 48 | 1.44 | good | |
| Comparative Example 1 | 126 | 85 | 27 | 36 | 3.87 | not well cleaned | Comp. |
| Example 7 | 121 | 101 | 32 | 32 | 1.49 | good | Inv. |
| Example 8 | 132 | 103 | 35 | 32 | 1.36 | good | |
| Example 9 | 110 | 100 | 38 | 41 | 2.15 | good | |
| Example 10 | 127 | 100 | 30 | 38 | 1.48 | good | |
| Comparative Example 2 | 78 | 100 | 52 | 129 | 3.30 | good | Comp. |
| Example 11 | 118 | 94 | 59 | 68 | 2.05 | good | Inv. |
| Example 12 | 119 | 93 | 57 | 79 | 2.22 | good | |
| Comparative Example 3 | 75 | 99 | 63 | 157 | 3.17 | not well cleaned | Comp. |

Inv.: Present invention, Comp.: Comparison

Table 1 reveals that the photoreceptors of the present invention minimize the electric potential fluctuation, $\Delta V_H$ (V) of the unexposed area, and the electric potential fluctuation, $\Delta V_L$(V) of the exposed area during repeated charging, exposure, and charge elimination, the decrease in the layer thickness of said photoreceptor due to abrasion as well as the degradation of halftone images during repeated image formation, and produces consistent images. On the other hand, Table 1 reveals that the comparative photoreceptors result in problems with any of the electric potential fluctuation, $\Delta V_L$(V) of the exposed area during repeated charging, exposure, and charge elimination, the decrease in the layer thickness of said photoreceptor due to abrasion as well as the degradation of halftone images during repeated image formation, and are not commercially viable.

Example 13

The CTL coating composition described below was applied onto the CGL of Example 1 so as to obtain a dry layer thickness of 23 μm. Thereafter, the resulting coating was dried at 100° C. for one hour to obtain the photoreceptor of Example 13, provided with the CTL in the multilayer structure. The Tg of the CTL of the resulting photoreceptor was 123° C., and the contact angle with respect to deionized water was 101°.

| CTL Coating Composition | |
|---|---|
| CTM-2 | 224 g |
| Resin (B-1) (having an Mv of 30,000) | 560 g |

-continued

| CTL Coating Composition | |
|---|---|
| Irganox 1010 (manufactured by Sankyo Co., Ltd.) | 1.2 g |
| 1.2-Dichloroethane | 2,800 ml |

The content ratio of the CTM in the CTL was 28.5 percent.

Example 14

The photoreceptor of Example 14 was obtained in the same manner as Example 13, except that in Example 13, 224 g of CTM-2 (28.5 percent) was replaced with 280 g (33.3 percent) of the same. The Tg of the CTL of the resulting photoreceptor was 119° C. and the contact angle was 102°.

Example 15

The photoreceptor of Example 15 was obtained in the same manner as Example 13, except that in Example 13, 224 g of CTM-2 (28.5 percent) was replaced with 336 g (37.4 percent) of the same. The Tg of the CTL of the resulting photoreceptor was 115° C. and the contact angle was 103°.

Comparative Example 4

The CTL coating composition described below was applied onto the CGL of Example 1 so as to obtain a dry layer thickness of 23 μm. Thereafter, the resulting coating was dried at 100° C. for one hour to obtain the photoreceptor of Comparative Example 4. The Tg of the CTL of the resulting photoreceptor was 79° C., and the contact angle with respect to deionized water was 100°.

| CTL Coating Composition | |
|---|---|
| CTM-6 | 224 g |
| Resin (B-1) (having an Mv of 30,000) | 560 g |
| Irganox 1010 (manufactured by Sankyo Co., Ltd.) | 1.2 g |
| 1.2-Dichloroethane | 2,800 ml |

The content ratio of the CTM-6 in the CTL was 28.5 percent.

Comparative Example 5

The photoreceptor of Comparative Example 5 was obtained in the same manner as Comparative Example 4, except that in Comparative Example 4, 224 g of CTM-6 (28.5 percent) was replaced with 280 g (33.3 percent) of the same. The Tg of the CTL of the resulting photoreceptor was 78° C. and the contact angle was 101°.

Comparative Example 6

The photoreceptor of Comparative Example 6 was obtained in the same manner as Comparative Example 4, except that in Comparative Example 4, 224 g of CTM-6 (28.5 percent) was replaced with 336 g (37.4 percent) of the same. The Tg of the CTL of the resulting photoreceptor was 74° C. and the contact angle was 101°.

<Evaluation>

Six types of photoreceptors of Examples 13, 14, and 15, and Comparative Examples 4, 5, and 6 were successively installed in a digital copier Konica 7060 which was modified so that the linear speed of the photoreceptor was variable. Further, said copier was modified, and a surface electrometer was provided. The process consisting of charging, exposure, and charge elimination was repeated 5,000 times, and electric potential fluctuations, $\Delta V_L(V)$ of an exposed area, at the commencement as well as after 5,000 repetitions were measured. Table 2 shows the results. The evaluation was carried out at three levels of a linear speed of the photoreceptor surface of 370 mm/second, 450 mm/second, and 520 mm/second.

TABLE 2

| | Properties of Surface Layer | | Electric Potential Fluctuation, $\Delta V_L$ (V), of Exposed Area Linear Speed (mm/sec) | | | |
|---|---|---|---|---|---|---|
| Embodiment | Content of CTM (%) | Tg (° C.) | 370 | 450 | 520 | Remarks |
| Example 13 | 28.5 | 123 | 36 | 59 | 79 | Inv. |
| Example 14 | 33.3 | 119 | 35 | 54 | 72 | |
| Example 15 | 37.4 | 115 | 35 | 51 | 68 | |
| Comparative | 28.5 | 79 | 48 | 118 | 235 | Comp. |

TABLE 2-continued

| | Properties of Surface Layer | | Electric Potential Fluctuation, $\Delta V_L$ (V), of Exposed Area Linear Speed (mm/sec) | | | |
|---|---|---|---|---|---|---|
| Embodiment | Content of CTM (%) | Tg (° C.) | 370 | 450 | 520 | Remarks |
| Example 4 | | | | | | |
| Comparative Example 5 | 33.3 | 76 | 40 | 81 | 157 | |
| Comparative Example 6 | 37.4 | 74 | 36 | 68 | 103 | |

Inv.: Present invention, Comp.: Comparison

Based on Table 2, it is found that the photoreceptors of the present invention minimize the electric potential fluctuation of the exposed area and the degradation of electrophotographic properties during repeated process consisting of charging, exposure, and charge elimination at such a high speed as a linear speed of said photoreceptor surface of at least 400 mm/second.

As proved in Examples, the photoreceptor of the present invention, the image forming method as well as the image forming apparatus employing said photoreceptor, and the photoreceptor in an apparatus unit which is removably attached to the apparatus body of said image forming apparatus, exhibit excellent advantages in which, during repeated image formation, especially image formation at high speed, the decrease in the layer thickness of said photoreceptor due to abrasion is minimized, the abrasion resistance is excellent, the cleaning properties are excellent, the electric potential fluctuations are minimized in the exposed and unexposed areas, fog is not formed, high density and sharp images are consistently obtained, and the like.

What is claimed is:

1. An electrophotographic photoreceptor which comprises an electrically conductive support having thereon a photosensitive layer in which the glass transition temperature of the surface layer of said photosensitive layer is at least 105° C. and the contact angle of said surface layer with respect to deionized water is at least 90°.

2. The electrophotographic photoreceptor of claim 1, wherein the surface layer of said photosensitive layer has a glass transition temperature of at least 120° C. and has a contact angle with respect to deionized water of at least 97°.

3. The electrophotographic photoreceptor of claim 1 wherein the surface layer comprises polycarbonate and viscosity average molecular weight of said polycarbonate is at least 50,000.

4. The electrophotographic photoreceptor of claim 3 wherein the surface layer comprises polycarbonate comprising a Si atom or a F atom.

5. The electrophotographic photoreceptor of claim 4, wherein the polycarbonate is a copolymer having a structure unit represented by formula (1).

(1)

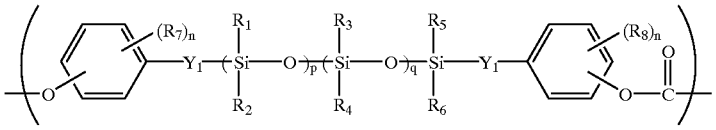

wherein $Y_1$ represents an alkylene group having from 1 to 6 carbon atoms or an alkylidene group, $R_1$ through $R_8$ each represents a hydrogen atom, a substituted or unsubstituted alkyl group having from 1 to 10 carbon atoms or a substituted or unsubstituted aryl group, n represents an integer of 1 to 4, and the sum of p and q represents an integer of 1 to 200.

6. The electrophotographic photoreceptor of claim 4, wherein the polycarbonate is a copolymer having a structure unit represented by formula (2).

(2)

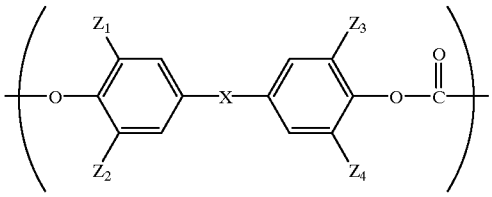

wherein X represents a single bond alkylidene group, a straight chain, branched chain or cyclic alkylidene group having from 1 to 15 carbon atoms, an alkylidene group substituted with an aryl group, an arylenediaklylidene group, —O—, —S—, —CO—, —SO—, or —$SO_2$—, and at least one of $Z_1$ through $Z_4$ represents a Si atom-containing group represented by formula (2') and each of others represents a hydrogen atom, an alkyl group having from 1 to 6 carbon atoms and an aryl group, (2')

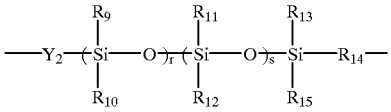

wherein $Y_2$ represents an alkylene group having from 1 to 6 carbon atoms or an alkylidene group, $R_9$ through $R_{15}$ each represents a substituted or unsubstituted alkyl group having from 1 to 10 carbon atoms or a substituted or unsubstituted aryl group, and the sum of r and s represents an integer of 1 to 200.

7. The electrophotographic photoreceptor of claim 4 the polycarbonate has a F atom containing structure unit in the copolymer structure or at the terminal of the same.

8. The electrophotographic photoreceptor of claim 1, wherein surface layer comprises a charge transport material having a molecular weight of at least 750.

9. The electrophotographic photoreceptor of claim 1, wherein surface layer comprises a charge transport material having a molecular weight of at least 900.

10. The electrophotographic photoreceptor of claim 1, wherein the content of the charge transport material in said charge transport layer is at least 30 percent by weight.

11. An image forming method wherein image formation is carried out employing a latent image forming means which forms an electrostatic latent image on the electrophotographic photoreceptor of claim 1, a transfer means which transfers to a transfer material the visualized toner image on said electrophotographic photoreceptor obtained by development, and a cleaning means which removes the toner remaining on said electrophotographic photoreceptor.

12. The image forming method of claim 11, wherein the image forming method, an electrostatic latent image is formed on an electrophotographic photoreceptor which moves in a linear speed of 400 mm/second, and development, transfer, and cleaning are carried out.

13. An image forming apparatus comprising a latent image forming means which forms an electrostatic latent image on the electrophotographic photoreceptor of claim 1, a transfer means which transfers to a transfer material the visualized toner image on said electrophotographic photoreceptor obtained by development, and a cleaning means which removes the toner remaining on said electrophotographic photoreceptor.

14. A unit wherein electrophotographic photoreceptor of claim 1, is integrally supported with at least one of a transfer means which transfers to a transfer material the visualized toner image on said electrophotographic photoreceptor obtained by development, and a cleaning means which removes the toner remaining on said electrophotographic photoreceptor, and is removably attached to an apparatus body.

15. The electrophotographic photoreceptor of claim 1 wherein said surface layer comprises fine organic resin particles having a volume average particle diameter which does not exceed 5 $\mu$m.

16. The electrophotographic photoreceptor of claim 15, wherein fine organic resin particles are fine particles of an organic resin containing a F atom.

* * * * *